310-322 SR
9/13/77 XR 4,048,454

United States Patent [19]

Barcus et al.

[11] 4,048,454

[45] Sept. 13, 1977

[54] SONIC TRANSDUCER EMPLOYING RIGID RADIATING MEMBER

[76] Inventors: Lester M. Barcus, 252 Tivoli Drive, Long Beach, Calif. 90803; John F. Berry, 3392 St. Albans Drive, Los Alamitos, Calif. 90720

[21] Appl. No.: 528,671

[22] Filed: Dec. 2, 1974

[51] Int. Cl.[2] ..... H04R 3/00; H04R 7/02; H04R 7/26; H04R 17/00

[52] U.S. Cl. ..... 179/110 A; 179/1 R; 179/180; 310/322; 310/326

[58] Field of Search ..... 179/110 A, 113, 121 T, 179/181 R, 181 W, 181 F, 180; 181/175, 176, 166, 153; 340/8 FT; 310/8, 8.2, 8.3, 8.4, 8.5

[56] References Cited

U.S. PATENT DOCUMENTS

| | | | |
|---|---|---|---|
| 2,341,275 | 2/1944 | Holland | 179/115.5 R |
| 2,427,062 | 9/1947 | Massa | 179/110 A |
| 3,019,660 | 2/1962 | Welkowitz | 310/8 |
| 3,101,419 | 8/1963 | Rich | 310/8.3 |
| 3,243,768 | 3/1966 | Roshon, Jr. et al. | 340/10 |
| 3,423,543 | 1/1969 | Kompanek | 179/110 A |
| 3,439,128 | 4/1969 | Sobel et al. | 179/110 A |
| 3,798,473 | 3/1974 | Murayama et al. | 310/8 |
| 3,846,779 | 11/1974 | Martner | 310/8.2 |

FOREIGN PATENT DOCUMENTS

| | | | |
|---|---|---|---|
| 217,579 | 6/1924 | United Kingdom | 179/181 R |

*Primary Examiner*—George G. Stellar
*Attorney, Agent, or Firm*—Albert L. Gabriel

[57] ABSTRACT

A sonic transducer incorporating a rigid plate-like transmitting member coupled to electromechanical compression wave generating means such as a piezoelectric crystal for transmitting sonic energy in a medium. The transmitting means is damped to prevent ringing, and the transducer is particularly responsive to the high frequency audio spectrum.

24 Claims, 18 Drawing Figures

FIG. 8
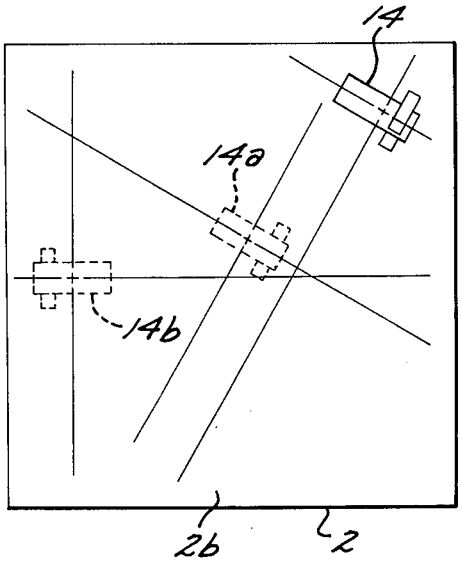
FIG. 9
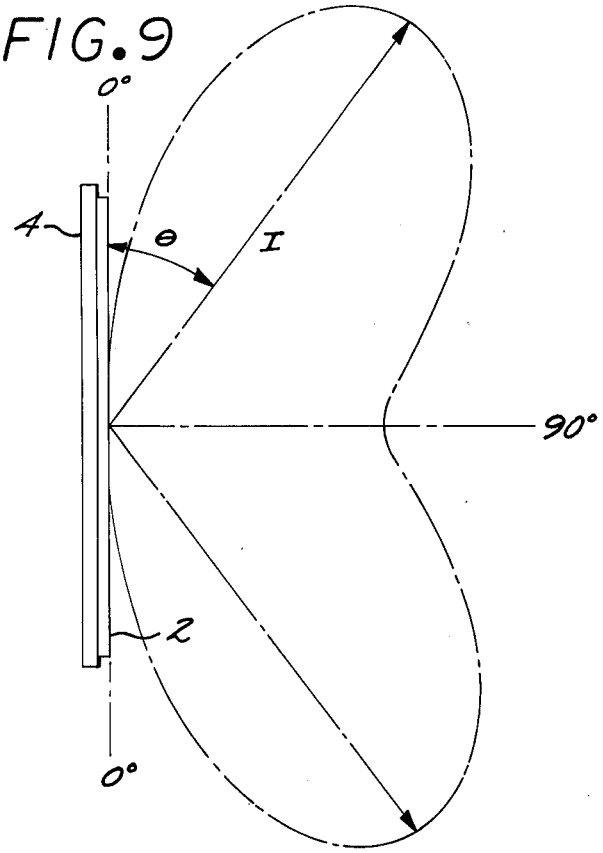
FIG. 11
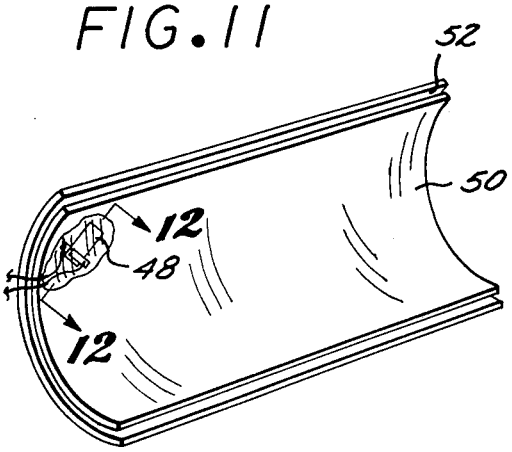
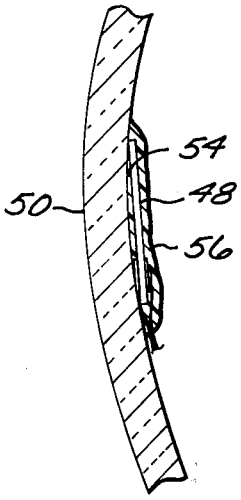
FIG. 12
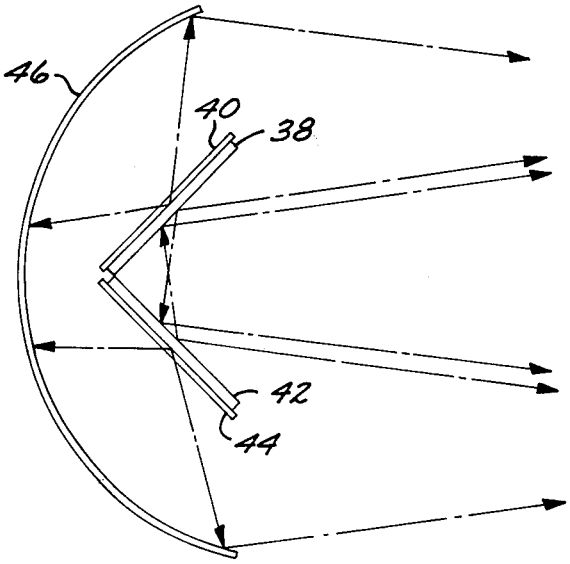
FIG. 10

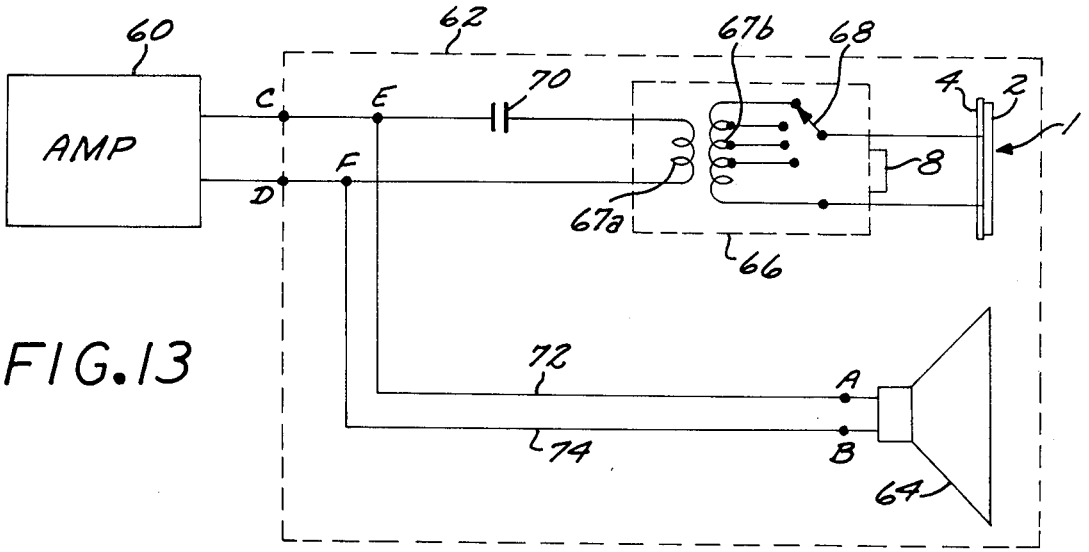
FIG.13
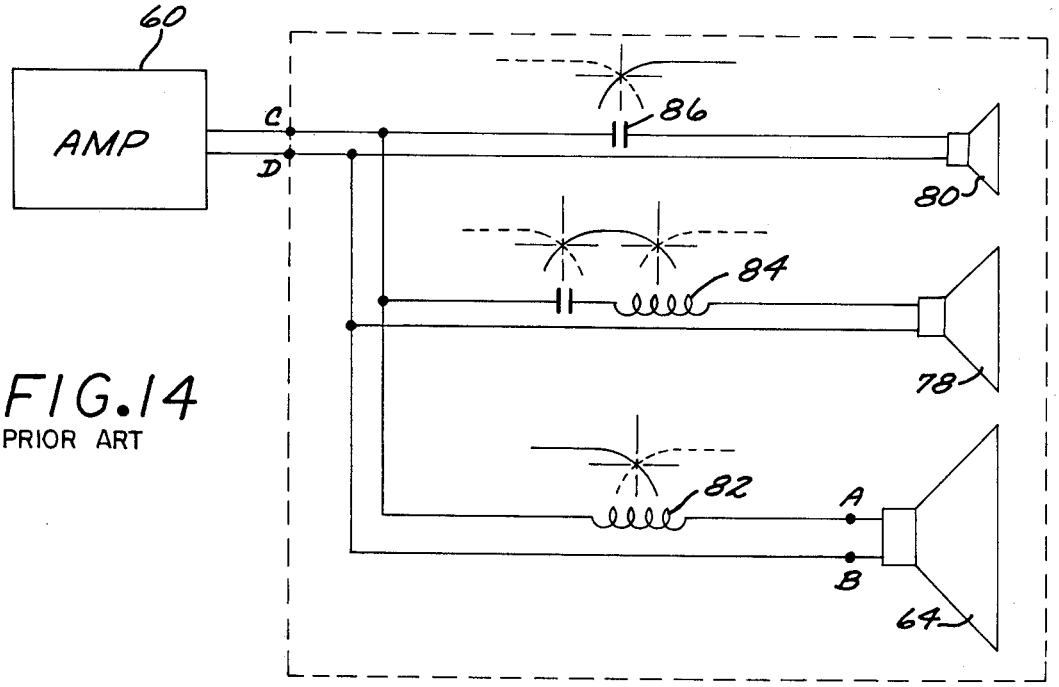
FIG.14
PRIOR ART
FIG.15A
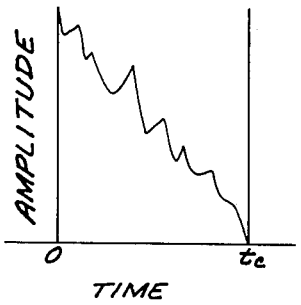
FIG.15B
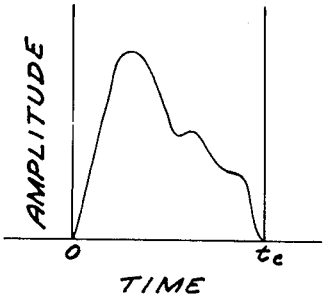
FIG.15C
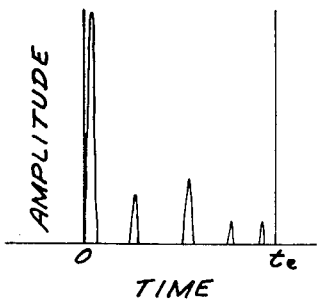

SONIC TRANSDUCER EMPLOYING RIGID RADIATING MEMBER

BACKGROUND OF THE INVENTION

1. Field of the Invention

The invention is in the field of sonic transducers as particularly applying to audio speakers.

2. Description of the Prior Art

The terms "sonic" and "sound" are used herein to mean the complete spectrum of compression wave frequencies including audio frequencies and frequencies above and below the audio range.

"Diaphragm-like movement" is defined as the gross flexural warping or bending associated with conventional speaker cones, thin membranes or plates.

Conventional sonic transducers and speaker systems utilize a diaphragm action to serve as an air pump to generate the compressional wave signals in the surrounding medium. Such systems show a high degree of inertial effects and are incapable of reproducing the peaks and sharp spikes which are associated with most sources of sonic energy. The waveforms associated with most sources which generate sonic energy (herinafter sometimes simply referred to as "sonic energy sources"), including but not limited to almost all natural sound sources, musical instruments, voice, sources of mechanical noises such as machinery, percussive or explosive sound sources, and other, consist to a large extent of abrupt amplitude spikes, pulses and other transients having abrupt rise and fall times. Thus, while most present day speaker systems are designed for low inertial impedance, they nevertheless are nonresponsive to short pulse durations, and are therefore inherently incapable of accurately reproducing the sounds generated by musical instruments, the human voice, and most other sonic energy sources. Conventional speaker systems even fail to accurately reproduce sine waves, since they flatten them out and thereby introduce distortions into them. Although many attempts have been made to reduce the inertia of typical diaphragm-type speakers, basic nonlinearity problems nevertheless exist and the diaphragm is inherently limited by its mechanical pistonlike action which serves as an air pump.

Piezoelectric crystals have been utilized both as air pumps per se and to drive diaphragms and produce flexural deformations in metallic air driving means such as shown in Spitzer et al U.S. Pat. No. 2,911,484, Ashworth U.S. Pat. No. 3,366,748, Watters et al U.S. Pat. No. 3,347,335 and Kompanek U.S. Pat. No. 3,423,543. These prior art teachings are designed to produce a flexing or mechanical deformation of the diaphragm or air driving member. Consequently, every effort has been made to support the air driving or diaphragm member with a minimum of friction and in an undamped structure. Such an arrangement is relatively inefficient and inherently incapable of reproducing fast rise time and fast fall time pulses.

Present day speaker arrangements usually require at least three separate speakers to reproduce the full range of audio frequencies. These speakers, the woofer, midrange and tweeter are connected to the audio amplifier output by sophisticated crossover networks so as to feed each speaker only those portiions of the frequency range which it is best able to reproduce. The relatively large inertia of the woofer makes it incapable of producing the high frequencies while the tweeter has small cone excursions suitable for high frequency reproduction but not low frequency reproduction. Even utilizing the crossover networks, however, tweeter designs are not capable of responding to the sharp spikes or high nearly instantaneous peaks associated with most sonic energy sources. Thus, while tweeters may be rated to respond to $20KH_z$ or more, this rating is relative to a sine wave input signal which is characteristic of an excited speaker cone; the weight or inertia of a diaphragm-like one is incapable of responding to the abrupt amplitude rise and fall times of most sonic energy sources, even though the sharp amplitude signals may exist on the tape or other program source. The inertial effect is a fundamental shortcoming of all diaphragm-type speakers.

The best tweeters available today are rated as being responsive to sine wave signals up to $25KH_z$. However, according to the accepted definition of square wave response a minimum of at least 10 octaves (of a sine wave) are necessary to approach a square wave. Thus, under this square wave definition, even the best tweeters only have a square wave response capability of one-tenth of $25KH_z$, or $2.5KH_z$, which is totally inadequate for responding to a large portion of the sonic energy content of most sonic energy sources.

New methods of deriving signals which eliminate the inertial effects of conventional microphones have particularly emphasized the serious inertial effect deficiencies of conventional speaker systems. For example, recordings can now be made with modern non-inertial type pick-ups, so that the recordings contain an electrical representation of sonic information that is far more accurate and complete than conventional speaker systems are capable of reproducing. As another example, piano sounds picked up by modern non-inertial pick-up systems become "cracked" or "break up" at predictable points when played through all conventional tweeters.

A further problem with conventional speakers is that the paper of conventional speaker cones inevitably introduces paper-like sounds into the speaker output, and even the metal diaphragm of a tweeter horn injects metal-like noises into the output. Such undesirable noises cannot be damped, since the speaker output depends upon the vibratory pumping action of such elements.

Diaphragm-like speakers also inherently produce a highly directional sound pattern which becomes more constricted with higher frequencies, and in the case of the high frequencies associated with tweeters takes the form of a narrow pencil-like radiation beam. The directional aspects of the diaphragm speakers makes their relative position and orientation an important and often expensive consideration in designing sophisticated audio speaker systems.

SUMMARY OF THE INVENTION

It is an object of the invention to produce a sonic transducer which is capable of generating a very high frequency sonic energy.

Another object of the invention is to produce a sonic transducer which is essentially free of diaphragm-like movement.

A further object of the invention is to provide a sonic transducer for radiating sonic energy which is much less directional than conventional diaphragm-like transducers and is substantially independent of the frequency of the radiated energy.

It is a further object of the invention to produce a tweeter speaker which is inexpensive and which may be easily designed and fabricated.

A further object of the invention is to provide a tweeter speaker which may be made in a form that is generally flat and compact, as well as attractive, and wherein these characteristics coupled with a generally omni-directional output permit considerable variety in placement and mounting, particularly in connection with woofer cabinets.

Yet another object of the invention is to provide a non-diaphragm-like tweeter speaker responsive to the high frequency audio range and to the sharp spikes associated with musical instruments, voice, and other sonic energy sources, for use in combination with a diaphgram-type woofer to provide a complete audio frequency response. The tweeter speaker of the present invention so faithfully reproduces the higher frequencies for which tweeters are intended, as well as the various spikes and pulses that are an inherent part of the lower frequency waveforms for which woofers are intended, that the resultant output of the woofer-tweeter combination is a very accurate and complete reproduction of the signals derived from the sonic energy source, without the requirement of any more than just the two speakers.

Yet another object of the invention is to provide a sonic transducer which is capable of reproducing all frequencies in the sonic spectrum including frequencies above and below the audio range as well as audio itself.

Yet a further object of the invention is to provide a speaker which is especially adapted to reproduce the high frequency audio and super-audio frequencies.

Another object of the invention is to provide an inexpensive tweeter speaker for use in a loud speaker system to provide great fidelity and clarity of response of the entire system.

The invention comprises a transmitting means such as a glass plate which is used to transmit the sonic energy to the surrounding medium. The transmitting means may, for example, be coupled to a piezoelectric transducer which in turn is connected to the sonic signal source. The transmitting means in both rigid and purposely damped to substantially eliminate any flexural or diaphgram-like action which has, heretofore, been thought absolutely necessary in a speaker system to energize the surrounding air or medium. The sonic transducer of the instant invention, however, purposely utilizes a rigid transmitting means which itself is substantially incapable of gross flexural deformations and which is damped to further eliminate flexural, diaphragm-like action. It is theorized that by eliminating such diaphragm-like movement the sonic energy is propagated primarily in a pressure or compressional wave through the transmitting means in directions principally parallel to the general plane thereof. The piezoelectric crystal acts as a compression wave generating means for transmitting the compressional energy generated therein to the transmitting means. The compressional energy itself is directly radiated to the surrounding medium such as air by the rigid, damped transmitting means. The speaker response is greatly enhanced, particularly with regard to its ability to follow high frequency signals which are virtually impossible to reproduce with conventional diaphragm-like action. The transducer arrangement thus provides signals having an extremely high fidelity, reproducing the "shimmering" presence of live musical instruments, and accurately reproducing voice or other sonic energy sources that include a substantial content of pulses and spikes having abrupt rise and fall times.

In contrast to the aforesaid square wave response capability of the best presently available tweeters of only about 2.5KH$_z$, sine wave response tests have been made with a prototype of the present invention up to 250KH$_z$, and at 250 KH$_z$ the sine wave output of the present tweeter appeared so completely undistorted that a still much higher actual frequency response was indicated. Thus, according to the aforesaid accepted square wave response definition, the present invention has been shown to have a square wave response of at least one-tenth of 250KH$_z$ or 25KH$_z$, and a still much higher square wave response is indicated.

BRIEF DESCRIPTION OF THE DRAWINGS

These and other objects of the invention will become more apparent in reference to the following description wherein:

FIG. 8 is a plan view of the electromechanical compression wave generating means in several orientations on the glass support plate;

FIG. 9 is an intensity distribution graph showing the sonic intensity around the surface of the transmitting means;

FIG. 10 is another embodiment of the invention for producing a directional speaker;

FIG. 11 is another embodiment of the invention showing a cylindrical transmitting means and damping means;

FIG. 12 is a cross-sectional view of the electromechanical driving means and mounting thereof taken along lines 12—12 of FIG. 11;

FIG. 13 is yet another embodiment of the invention wherein the present speaker is mounted in a full range sonic system;

FIG. 14 shows a conventional speaker system utilizing three separate speakers for each channel and associated crossover network;

FIGS. 15A–15C show graphical representations of the response of conventional speakers and of the speaker of the invention.

DETAILED DESCRIPTION OF THE PREFERRED EMBODIMENT

Figure 1:
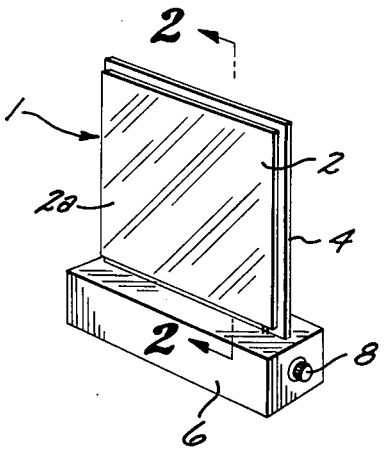
FIG. 1 is a perspective view of one form of the invention.
Figure 2:
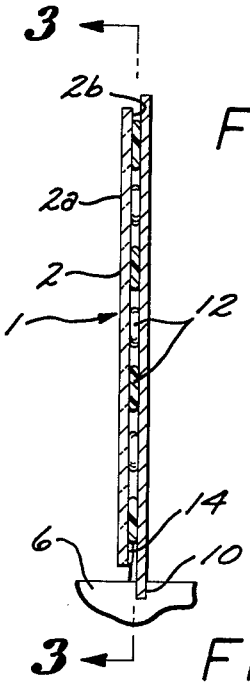
FIG. 2 is a cross-sectional view taken along lines 2—2 of FIG. 1.

As shown in FIGS. 1 and 2, the speaker or sonic transducer 1 comprises a transmitting means 2 having a first surface 2*a* fully exposed to the surrounding medium and a second or back surface 2*b*. The back surface 2*b* of the transmitting means 2 is secured to a support member or damping means 4. The damping means 4 is attached to a base member 6 by insertion of the damping means in a groove 10 within the base member 6. Optionally, the damping means may be secured by means of epoxy or other adhesive to the base support member 6. Attached to the base member 6 is a control means 8 in the form of a dial having a plurality of positions.

Figure 3:
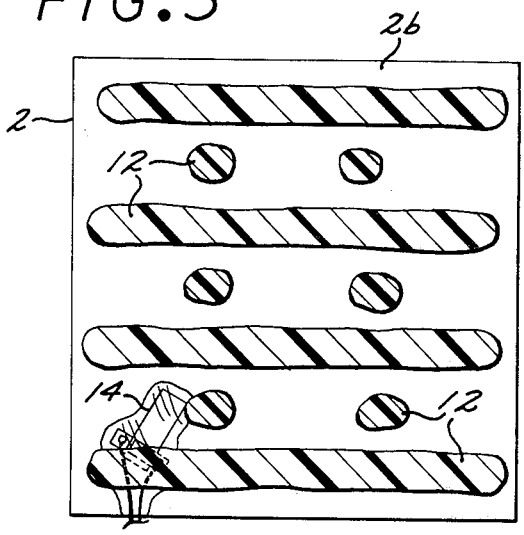
FIG. 3 is a cross-sectional view taken along lines 3—3 of FIG. 2.

The transmitting means 2 is connected to the damping means 4 via an adhesive material 12 as shown in FIGS. 2 and 3. In fabricating a speaker such as a tweeter for use in reproducing audio frequencies, the transmitting means 2 is preferably made of ⅛ inch double weight glass cut in a square configuration approximately 6 × 6 inches. The damping means 4 is preferably a wooden platelike member bound to the transmitting means by strips of adhesive material 12, such as silicone rubber or mastic. As shown in FIG. 3, a plurality of strips of adhesive material 12 may be utilized so that the transmitting means and damping means are secured together over approximately 30% of their adjoining surface areas.

As seen in FIGS. 2 and 3, a compression wave generating means 14 is provided on the transmitting means 2. The compression wave generating means 14 may, for example be an electromechanical transducer such as a piezoelectric crystal. Piezoelectric crystals made of lead zirconate titanate having a dimension of 1½ × ½ inch × 40 mils have been utilized with great success.

It has been found that it is best to use a crystal dimension having a length approximately equal to one-half the distances between nodes of natural interference patterns established by the reflecting sonic compression waves in the transmitting means 2, e.g. glass plate. These nodal patterns may readily be observed by sprinkling granular particles such as salt on a horizontally disposed, energized transmitting means 2. If the crystal length is longer than this optimum value, the upper end frequency response will be limited, whereas a much shorter crystal length will result in a reduction of efficiency. By having the width of the crystal considerably less than the length, e.g. ½ inch vs. 1½ inch, the high frequency response appears to be enhanced. A relatively large crystal contact surface area is desired for providing optimum transfer of heat energy from the crystal to the glass. For this reason, it is preferred to have full surface bonding between the crystal and the glass. Nevertheless, bonding of the end portions of the crystal to the glass will generally be adequate.

The thickness of the crystal is not critical as long as electrode voltages are maintained below the puncture value of the crystal. If the crystal is too thin, the applicable voltage is limited by the low puncture value of the crystal and by a tendency for arcing around the edges, whereby heavy current and hence heavy power consumption will be required for a given sonic output. On the other hand, if the crystal is too thick, then the operating voltage may become undesirably large. A crystal thickness in the range of about 20–60 mils is preferred, and a presently preferred thickness is about 40 mils. The puncture value for a 40 mil crystal is approximately 2000 volts. The only power limitation observed with prototypes of the present invention appears to be the thickness of the crystal, so that if increased power handling capability is desired, a thicker crystal should be used. The present invention has a much greater power-handling capabiity than the approximately 30 watt limitation for conventional speakers. Thus, a prototype of the present invention having a crystal 40 mils thick has satisfactorily been driven with 100 watts without appearing to be anywhere near its power limitations.

The thickness of the transmitting means must be such as to insure a rigid non-flexible structure. Extremely thin flexible members such as those exhibiting conventional diaphragmlike movement have been ineffective. If a glass plate transmitting means 2 is too thin, there is a dropoff in efficiency which appears to result from friction losses of the sonic energy in the plate, as well as a tendency for the plate to become flexible. On the other hand, if the glass plate is too thick, there is also a dropoff in efficiency, which appears to result from increased reflections of the sonic energy in the plate. Although ⅛ inch double weight window glass works extremely well, thicker glass may be used, but efficiency begins to drop off at a thickness of about ¼ inch.

The 6 × 6 inches square configuration for a glass plate transmitting means 2 is desirable as being sufficiently large to be close to maximum efficiency in transmitting sonic energy, as having good frequency response, and as being convenient for fabricating and mounting. A prototype of the present invention wherein the speaker 1 embodied a 6 × 6 inches double weight window glass plate as the transmitting means 2 exhibited an electricsonic conversion efficiency that was substantially greater than that of a conventional tweeter, as evidenced by a much lower electrical power input to the present invention for the same output volume. Frequency response of this prototype speaker 1 was from about 1200 $H_z$ on up to at least the measured 250 $KH_z$ referred to above, and appeared to in fact extend much higher than that.

Nevertheless, other sizes and shapes may be employed with good results. A substantial increase in area does not appear to appreciably improve the conversion efficiency, but it does appear to increase the frequency response range to include slightly lower frequencies. A large decrease in area, as for example a reduction in size to a 3 × 3 inches square having only one-fourth the area of the 6 × 6 inches square, will result in a substantial decrease in conversion efficiency, and a somewhat higher minimum frequency response. Rectangular, circular, triangular, and other configurations of the transmitting means 2 provide satisfactory conversion efficiencies and frequency responses.

While glass is the presently preferred material for the transmitting means 2, the invention is not limited to the use of glass. Thus, optionally a plate of hard, brittle tool steel may be used. A criterion for a suitable material for the transmitting means 2 is that a body of the material suspended without damping will, upon being struck, emit a bell-like sound.

The damping means 4 is coupled to the transmitting means 2 primarily to eliminate any natural ringing frequencies. However, the damping means 4 must not be so large and massive as to reduce efficiency by absorbing the sonic energy. In use with a ⅛ inch double weight glass plate, a sheet of plywood roughly the same thickness of the glass plate has been found to work well. In general the less massive the damping material the better, as long as the natural ringing frequencies of the transmitting means are eliminated, so as to minimize diversion and dissipation of the useful sonic energy and eliminate the introduction of undesired output noises. The damping means is thus usually less massive than the transmitting means. Some suitable alternatives for the damping means 4 are a sheet of plastic material mounted similarly to the plywood sheet, spaced globs of mastic or elastomeric material adhered to the rear surface 2*b* of the transmitting means 2, or a sheet of cork secured to the rear surface 2*b*.

The damping means 4 may also be secured to both surfaces 2*a* and 2*b* of the transmitting means if desired, as for example, for aesthetic reasons. Some loss of efficiency will result although the frequency response of the speaker is unimpaired.

Figure 4:
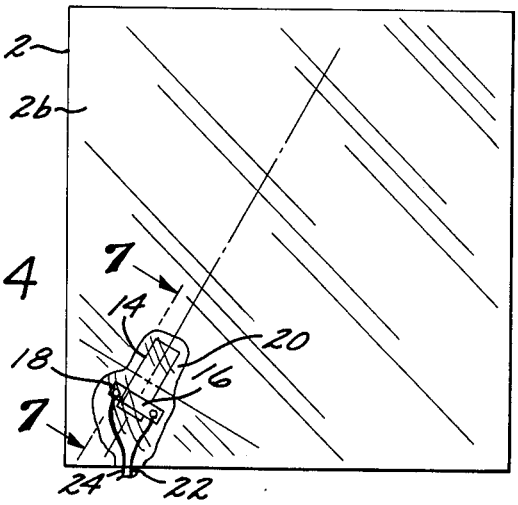
FIG. 4 is a plan view of the form of the invention illustrated in FIGS. 1 to 3, showing the positioning of the electromechanical compression wave generating means of the plate transmitting memnber.

FIG. 4 shows one orientation of the piezoelectric crystal 14 in relation to the back surface 2*b* of the transmitting means 2. Electrodes 16 and 18 are secured to opposite faces of the crystal as is better illustrated in FIGS. 5–6. Coupling means 20, such as epoxy, secures the crystal to the transmitting means 2. Leads 22 and 24 are connected to electrodes 16 and 18, respectively, and are further connected to one channel of an amplifier or an electronic signal generator (see FIG. 16 for example).

Although the crystal 14 has been shown operatively associated with the back surface 2*b* of the transmitting means 2, this is primarily for aesthetic reasons, and it is to be understood that the crystal may alternatively be mounted on the front surface 2a of the transmitting means 2.

Figure 5:
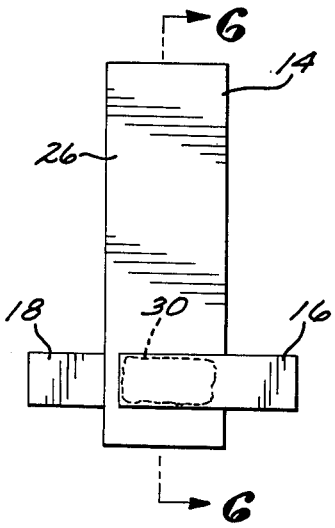
FIG. 5 shows the electrode connection to the electromechanical compression wave generating means.
Figure 6:
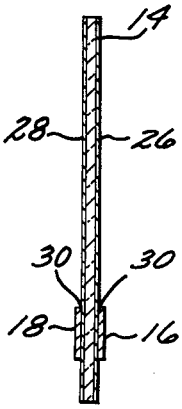
FIG. 6 is a cross-sectional view of the electromechanical compression wave generating means taken along the lines 6—6 of FIG. 5.
Figure 7:
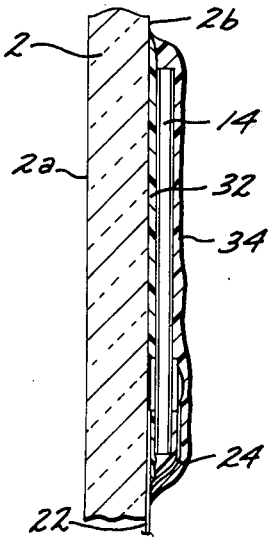
FIG. 7 is a cross-sectional view of the electromechanical compression wave generating means mounted on the glass support plate taken along lines 7—7 of FIG. 4.

As seen in FIGS. 5–7, the piezoelectic crystal 14 has silver-coated surfaces 26 and 28 to which are attached the respective electrodes 16 and 18 by means of solder 30. Once the electrodes are securely fastened to the surfaces 26 and 28, the leads 22 and 24 are soldered to their respective electrodes and the structure is secured to the transmitting means 2 utilizing a first layer of adhesive material 32 which may be a simple epoxy mixture. A rigid adhesive, such as rigid epoxy, is preferred, as it appears to preserve a good impedance match between the crystal 14 and the transmitting means 2 (e.g. glass), which are both very rigid. The bond between the crystal 14 and the transmitting means 2 is also preferably an intimate molecular-type bond such as is provided by epoxy, for optimum heat and sonic energy transfer from the crystal 14 to the transmitting means 2. The crystal 14 together with the electrodes and connecting wires are further coated with a second layer of adhesive material 34 serving to protect the structure and provide electrical isolation.

FIG. 8 discloses the crystal 14 in solid lines showing yet another acceptable orientation of the crystal with respect to the glass transmitting means 2. Crystal 14*a* (in phantom lines) illustrates yet a third possible orientation of the crystal. However, crystal 14*b* is oriented in a less desirable position in that the symmetrical orientation of the crystal with respect to the peripheral edges of the transmitting means results in compression wave cancellations which tend to lower the efficiency of the speaker as a whole. Thus, while various permutations of shapes for the transmitting means 2 and/or crystal 14 are readily usable (circular, triangular, etc.), it is preferably to avoid mounting the crystal 14 in a symmetrical relation with respect to the transmitting means 2. The orientation should be selected so as to enhance the production of randomly directed compressional waves. Orienting the crystal 14 in nonsymmetrical orientations permits a well distributed compressional wave signal throughout all sections of the transmitting means 2 and thus improves transmitting efficiency for all compression wave frequencies.

It has been found that a single crystal 14 produces much better results than a plurality of crystals which is probably due to cancellations of compressional energy when multiple crystals are employed similar to the cancellations associated with symmetrical orientations of a single crystal.

FIG. 9 shows a schematic diagram of the intensity, I, of the sonic energy emanating from the front face of the transmitting means 2 as a function of angle $\theta$ wherein zero degrees is defined to be in the plane of the transmitting means 2. As shown, the optimum intensity appears to be along the 35°–40° line with less intensity both at 0° and 90°. The intensity distribution is symmetric about the $\theta = 90°$ and appears to be identical on either side of the transmitting means 2, except for some attenuation by the damping means 4.

FIG. 10 illustrates another embodiment of the invention wherein two transmitting means and two associated damping means are shown. The transmitting means 38 is damped by the damping means 40 and is oriented at a substantial angle (e.g. 90°) relative to a second transmitting means 42 and associated damping means 44. The orientation of the pair of transmitting means helps to direct the maximum sound intensity in a generally horizontal direction as shown. Since the radiation is symmetric on each side of the transmitting means, a sonic reflector 46 may be provided to reflect the energy emanating from the back surfaces of the transmitting means 38 and 42 through the associated damping means 40 and 44, respectively.

FIG. 11 shows yet another embodiment of the invention wherein a piezoelectric crystal 48 is mounted on an open cylindrical transmitting surface 50 which itself is damped by a concentrically mounted open cylindrical damping means 52. Silicone rubber may be utilized to secure the transmitting means 50 to the damping means 52. As shown in FIG. 12, a piezoelectric crystal 48 and the associated electrodes and connecting wires are secured to the front face of the transmitting means 50 by utilizing a first and second layer of epoxy 54 and 56, respectively.

FIG. 13 shows an embodiment of the invention incorporated in a dual speaker system which is capable of reproducing the very sharp spikes and peaks characterized by a fast rise time and fast fall time associated with musical instrument, voice, and most other sonic energy sources. As shown in FIG. 13, an amplifier 60 is connected to the speaker system 62 at connecting terminal points C and D. The speaker system 62 comprises the speaker 1 and a conventional diaphragm-type woofer speaker 64. Speaker 1 comprises the transmitting means 2 and damping means 4, and the piezoelectric crystal (not shown) is connected to an air core transformer 66 having tap changing means 68. The transformer 66 has primary and secondary windings 67*a* and 67*b* as shown. The control knob 8 as shown in FIGS. 1 and 13 is utilized to change the tap changing means 68 to provide varying electrical potentials on the piezoelectric crystal 14, thus providing full volume control. The air core transformer 66 is utilized to eliminate the hysteresis effects associated with the conventional iron core transformers. A high pass filter capacitor 70 is provided in the primary circuit of the transformer 66 as shown in FIG. 13. Capacitor 70 may, for example, have a value of 20 microfarads, and is used primarily to prevent shorting out the woofer 64 at very low frequencies (approximately 100 $H_z$). Woofer speaker 64 is connected at points E and F through lines 72 and 74 in parallel with the primary circuit of the air transformer 66, on the amplifier side of capacitor 70.

It is understood that the arrangement as shown in FIG. 13 is connected into one channel of the amplifier 60 and, for example, in a stereo application, a second speaker system 62 would be utilized and, likewise, four speaker systems 62 would be utilized for quadraphonic sound.

In FIG. 14 there is shown a conventional three speaker arrangement which utilizes the woofer 64, mid-range speaker 78 and tweeters 80. In the conventional systems, each speaker is associated with a filter network so that the speaker is limited in the frequency input spectrum. For example, a low pass filter 82 is associated with the woofer 64, band pass filter 84 is associated with the mid-range speaker 78 and a high pass network 86 is associated with the tweeter 80. One may readily convert the conventional crossover network utilizing three speakers (FIG. 14) to the two speaker system as shown in FIG. 13. In making the conversion, the entire crossover network of FIG. 14 is disconnected at terminals C and D. The woofer 64 is then connected as shown in FIG. 13 wherein terminals A and B of woofer 64 are connected at points E and F by lines 72 and 74, as shown. One simply disconnects the entire crossover network and allows the woofer 64 to freely respond to all frequencies without conventional filtering. The woofer 64 thus has a wider dynamic range and is more compatible with speaker 1. FIG. 15A shows an amplitude vs. time representation of one complete cycle of the low E string of a bass fiddle at 42.25 $H_z$. Time $t_c$ represents 1/42.52 second. As can be seen in FIG. 15A, a single note is actually composed of a plurality of sharp spikes or peaks each having a relatively small width and a relatively small rise time and fall time. FIG. 15B shows the conventional response of most speaker systems. As may be seen, diaphragm-like speakers cannot respond to the sharp peaks in the waveform. The inertia of even small diaphragms makes these speakers unresponsive to the very high frequency components of the waveform, and they thus produce only an average response which lacks the crispness or shimmering sound of the real instrument.

FIG. 15C shows the effect of subtracting the waveform of FIG. 15B from the waveform of FIG. 15A. The resulting peaks and sharp spikes may be followed by the speaker of the invention with great fidelity as no diaphragm-like motion is required. With the addition of a woofer speaker which is responsive to the slower varying waveforms of FIG. 15B, the true waveform of the musical instrument as represented by FIG. 15A may be readily reproduced. The improvement and clarity of sound is readily apparent.

Figure 16:
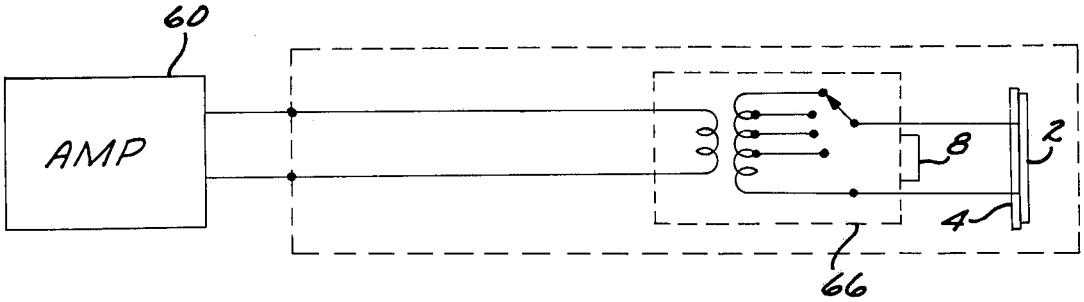
FIG. 16 is another embodiment of the invention.

Applicants' invention may, of course, be utilized as a single speaker element as shown in FIG. 1 without the second speaker or woofer. The use of a single speaker is shown in FIG. 16. The transmitting means 2 and damping means 4 sandwich the crystal (not shown) which is connected to the air core transformer 66 as in FIG. 13. However, the woofer 64 and capacitor 70 of FIg. 13 are now removed and the air core transformer 66 is connected directly to the output of amplifier 60. A capacitor may be utilized as in FIG. 13 if it has a sufficiently high value to provide low impedance for the low frequency ranges. The speaker arrangement of FIG. 16 is particularly suited to reproduce audio voice signals and thus suited for use in loudspeaker systems for example.

In the speaker system of FIG. 16, wherein the woofer does not take any of the signal, the full frequency range of the speaker 1 will be available, i.e., on the order of about 1200 $H_z$ and above. The frequency response of the speaker 1 in the system of FIG. 13 will be on the order of about 2000 $H_z$ and above.

In utilizing the invention, the plurality of shapes available for the transmitting means 2 (FIG. 11, for example) allows the fabrication and design of a speaker having greatly enhanced aesthetic qualities and decorative effects. Since the transmitting means 2 is in fact intentionally damped by means of the damping means 4, it is apparent that the speaker 1 may be utilized both as a speaker and support for conventional pictures, and in fact, the surface of the transmitting means 2 may be used directly to imprint pictures and the like. The flat, compact configuration of the transmitting means 2 make it readily adaptable for convenient, attractive, and inconspicuous mounting in connection with a woofer cabinet. Thus, while the transmitting means 2 and damping means 4 as embodied in speaker 1 with base support member 6 may be disposed on top of a woofer cabinet, or on some other nearby item of furniture, without the base support member 6 they may conveniently be hung on the back or side of the woofer cabinet or elsewhere where they will be inconspicuous. The present tweeter speaker thus does not require that the usual opening be cut in the woofer box, and also does not require the usual baffling.

A sonic transducer according to the present invention is capable of accurately and completely reproducing all of the sounds which now can be picked up and recorded by modern noninertial type pickups, including many sounds which have extremely fast rise and fall times that were not reproducible through conventional speaker systems. Thus, with the present sonic transducer, for the first time such sounds can be heard as the rosin on the bow of a bowed instrument, a wire brush on a drum, tambourine jingles, maraca beads, and the like, and these sounds are faithfully reproduced by the invention.

The present sonic transducer is also highly sensitive to single pulses, even in the microsecond duration range, regardless of the pulse repetition rate. Nevertheless, the invention will also reproduce pure sine waves in a manner which appears to be totally free of distortion, as compared to the flattening of sine waves by conventional speakers. The present invention also preserves th dynamic linearity of the source, as compared to the inherent non-linearity of conventional diaphragm-type speakers.

As will be apparent from the intensity diagram of FIG. 9, the output of a tweeter speaker according to the invention is generally omni-directional, as compared to the highly directional sound pattern of conventional diaphragm-type tweeters. Additionally, speakers according to the present invention exhibit a sound-carrying or projection power that is much greater than that of conventional speakers of the diaphragm type.

Conventional diaphragm-type speakers having an "averaging" effect which makes record surface noise generally quite audible as a sort of "white" background noise. However, such surface noise consists of a large number of discrete spikes that are mostly of very low amplitude, and the sharp pulse response of the present transducer separates these small spikes out, virtually eliminating such averaging, and thereby greatly reduces the audibility of such surface noise, by a factor of many times.

The sonic transducer of the present invention does not itself generate or introduce undesired sounds into its output. Thus, the invention does not have any inherent sound outputs of its own such as the paper sounds of conventional speaker cones or the metal-like noises of conventional tweeter horns. Further, piano sounds picked up by modern non-inertial pickups do not "crack" or "break up" when played through the present sonic transducer like they do when played through conventional tweeters.

A particularly important aspect of the present sonic transducer is its ability to enormously enhance the intelligibility of speach, which is almost entirely made up of pulses, spikes, and other transients. The present transducer appears to accurately and completely reproduce certain inherent contents of voice waveforms which are closely related, qualitatively, to the intelligibility of speech.

While the invention has been described with reference to the above disclosure relating to the preferred embodiments, it is understood the numerous modifications or alterations may be made by those skilled in the art without departing from the scope and spirit of the invention as set forth in the claims.

We claim:

1. A sonic transducer for transmitting sonic signals in a medium comprising:

piezoelectric sonic energy generating means, said generating means having opposed generally planar electrodes, sonic energy transmitting means, said transmitting means being sheet-like and rigid and substantially incapable of flexural and diaphragm-like movement, coupling means for coupling said generating means to said transmitting means, said coupling means coupling said generating means to said transmitting means with said electrodes of said generating means oriented principally parallel to the general plane of said sheet-like transmitting means, and means for damping the natural resonant frequencies of said transmitting means.

2. A sonic transducer as recited in claim 1 wherein said generating means has a thickness between about 20 mils and about 60 mils.

3. A sonic transducer as recited in claim 1 wherein said generating means is rigidly secured to said sheet-like transmitting means and oriented non-symmetrically to the peripheral edges of said transmitting means to produce randomly directed compressional waves in said transmitting means.

4. A sonic transducer as recited in claim 1 wherein said piezoelectric means comprises a single generating crystal.

5. A sonic transducer as recited in claim 1 wherein said transmitting means comprises first and second platelike members oriented at a substantial angle to one another thereby providing a directional sonic energy pattern into said medium.

6. A sonic transducer as recited in claim 5 further comprising reflector means adjacent said first and second members for further directing said sonic energy.

7. A sonic transducer as recited in claim 1, wherein said gnerating means has a rectangular shape and a length approximately equal to 1½ inches and a width of approximately equal to ½ inch.

8. A sonic transducer as recited in claim 7 wherein said coupling means is an electrically insulating adhesive and said damping means is generally flat.

9. A sonic transducer as recited in claim 1 wherein said transmitting means is generally flat.

10. A sonic transducer as recited in claim 9 wherein said damping means is sheet-like and generally flat.

11. A sonic transducer as recited in claim 9 wherein the transmitting means comprises glass.

12. A sonic transducer as recited in claim 11 wherein said transmitting means is a single glass plate.

13. A sonic transducer as recited in claim 12 wherein said single glass plate is approximately ⅛ inch thick.

14. A sonic transducer for transmitting sonic signals in a medium comprising:

compression wave generating means, transmitting means, said transmitting means being rigid, substantially incapable of flexural and diaphragm-like movement and being sheet-like and generally flat, said transmitting means comprising glass, coupling means for coupling said generating means to said transmitting means, means for damping the natural resonant frequencies of said transmitting means, and said damping means being sheet-like and generally flat and comprising a rigid wooden body adhesively secured to said transmitting means.

15. A sonic transducer as recited in claim 14 wherein said compression wave generating means comprises piezoelectric means.

16. A sonic transducer as recited in claim 15 wherein said damping means has a mass less than the mass of said transmitting means.

17. A sonic transducer for transmitting sonic signals in a medium comprising:

compression wave generating means, transmitting means, said transmitting means being rigid and substantially incapable of flexural and diaphragmlike movement, said transmitting means being generally curved, coupling means for coupling said generating means to said transmitting means, and means for damping the natural resonant frequencies of said transmitting means.

18. A sonic transducer as recited in claim 17 wherein said damping means is generally curved.

19. A sonic transducer as recited in claim 18 wherein said damping means is positioned closely adjacent said transmitting means and coupled thereto by adhesive means, said damping means having approximately the same curvature as said transmitting means.

20. A speaker system for radiating sonic energy into a medium and for use with an audio amplifier supplying electronic audio signals comprising:

a. compression wave generating means, b. means for transmitting sonic energy into said medium, said transmitting means being rigid and substantially incapable of flexural movement, c. coupling means for coupling said generally means to said transmitting means, d. means connected to said transmitting means for damping gross vibrations of said transmitting means associated with natural resonant frequencies of said transmitting means, e. an air core transformer having a primary winding connected to receive said audio signals, said transformer having a secondary winding connected to said compression wave generating means, f. a diaphragm-type woofer speaker connected in parallel with said primary winding of said air core transformer, and g. capacitor means connected in series with said primary winding of said air core transformer.

21. A speaker system as recited in claim 20 wherein said transmitting means comprises glass.

22. A speaker system as recited in claim 20 wherein said compression wave generating means comprises piezoelectric means.

23. A speaker system for radiating sonic energy into a medium and for use with audio amplifier supplying electronic audio signals comprising:

a. compression wave generating means, b. means for transmitting sonic energy into said medium, said transmitting means being rigid and substantially incapable of flexural movement, c. coupling means for coupling said generating means to said transmitting means, d. means connected to said transmitting means for damping gross vibrations of said transmitting means associated with natural resonant frequencies of said transmitting means, and e. an air core transmformer having a primary winding connected to receive said audio signals, said transformer having a secondary winding connected to said compression wave generating means.

24. A speaker system as recited in claim 23 wherein said transmitting means comprises glass.

* * * * *